US007794253B2

(12) United States Patent
Wang et al.

(10) Patent No.: US 7,794,253 B2
(45) Date of Patent: Sep. 14, 2010

(54) COAXIAL CONNECTOR WITH A NEW TYPE OF CONTACT

(75) Inventors: Leland Wang, Shenzhen (CN); Shih-Chi Hsiao, Tu-Cheng (TW); Jin-Liang Du, Shenzhen (CN); Jun Zhou, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/496,667

(22) Filed: Jul. 2, 2009

(65) Prior Publication Data

US 2010/0003842 A1 Jan. 7, 2010

(30) Foreign Application Priority Data

Jul. 2, 2008 (CN) ..... 2008 2 0040264

(51) Int. Cl.
*H01R 29/00* (2006.01)

(52) U.S. Cl. ..... 439/188; 439/63

(58) Field of Classification Search ..... 439/63, 439/83, 188, 578, 944; 200/51.05, 51.09, 200/51.1

See application file for complete search history.

(56) References Cited

U.S. PATENT DOCUMENTS 6,554,630 B2 * 4/2003 Uratani ..... 439/188
6,783,374 B2 * 8/2004 Uratani et al. ..... 439/83
6,808,405 B1 * 10/2004 Uratani et al. ..... 439/188
6,843,673 B1 * 1/2005 Liu et al. ..... 439/188
7,097,480 B2 * 8/2006 Fukuzaki et al. ..... 439/188
7,513,778 B1 * 4/2009 Dar-Shan ..... 439/63

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

A coaxial connector for receipt of a central contact of a complementary coaxial connector to be inserted therein, comprising an insulative case including an upper insulative case portion and a lower insulative case portion; an upper fixed contact, a movable contact and a bottom fixed contact essentially stacked in the space section; the upper fixed contact arranged to be sandwiched by the upper insulative case portion and the lower insulative case portion, the upper fixed contact having a planar contact part along a lengthwise direction; the movable contact having a central planar contact section, the central planar contact section arranged to initially come into contact with the contact part of the upper fixed contact; wherein the contact section of the movable contact is arranged to be movable from a position at which the movable contact is in contact with the upper fixed contact to a position at which the movable contact is separated from the upper fixed contact while not coming into contact with the bottom fixed contact in accordance with attachment and detachment of a complementary coaxial connector.

9 Claims, 5 Drawing Sheets

COAXIAL CONNECTOR WITH A NEW TYPE OF CONTACT

BACKGROUND OF THE INVENTION

1. Field of the Invention

The present invention relates to an electrical connector, especially to a coaxial connector having improved contact with a planar contact surface defined thereon.

2. Background of the Invention

Coaxial connectors are known to set up an electrical connection between an electronic component and a printed circuit board. U.S. Pat. No. 6,554,630 discloses a type of connector mounted to a printed circuit board. The connector comprises a frame, a movable spring portion having two ends that are supported by the frame and a central portion thereof that is movable and is elastic; a contact portion that is integral with the movable spring portion and that is arranged to come into contact with and connect to a fixed terminal; a fixed portion that is integral with the frame and is arranged to be sandwiched by an upper insulating case portion and a lower insulating case portion of a coaxial connector; and a lead extending from the fixed portion; wherein the fixed portion includes at least one recess provided therein for being fitted to a leg disposed on the upper insulating case portion of the coaxial connector so as to accurately locate the movable terminal with respect to the upper insulating case portion.

Unfortunately, problems are encountered with the coaxial connectors mentioned above. The top surface of the movable spring portion presents a shape of arc providing a point contact with a contact of a complementary connector. This kind of structure always leads to a misconnection between the mating coaxial connector and the coaxial connector due to providing a point contact therebetween.

Hence, an improved coaxial connector is needed to solve the above problem.

SUMMARY OF THE INVENTION

An object, therefore, of the invention is to provide a new and improved coaxial connector of the character described able to provide a planar surface contact, thereby preventing the misconnection between the coaxial connector and the mating coaxial connector.

In order to achieve the object set forth, a coaxial connector in accordance with the present invention comprises an insulative case including an upper insulative case portion and a lower insulative case portion, the lower insulative case portion defining a space section thereof; an upper fixed contact, a movable contact and a bottom fixed contact essentially stacked in a vertical direction and received in the space section; the upper fixed contact arranged to be sandwiched by the upper insulative case portion and the lower insulative case portion, the upper fixed contact having a planar contact part along a lengthwise direction; the movable contact having a central planar contact section, along a transverse direction perpendicular to said lengthwise direction, that is movable and elastic, the central planar contact section arranged to initially come into contact with the contact part of the upper fixed contact, the movable contact further including first and second down ends integrally connected to the central planar contact section and retained by the lower insulative case portion, said first down end constantly contacting with a planar part of the bottom fixed contact; the bottom fixed contact having the planar part on a bottom surface of the space section, and a solder tail retainably extending out of the lower insulative case portion; and wherein the contact section of the movable contact is arranged to be movable from a position at which the movable contact is in contact with the upper fixed contact to a position at which the movable contact is separated from the upper fixed contact while not coming into contact with the bottom fixed contact in accordance with attachment and detachment of a complementary coaxial connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
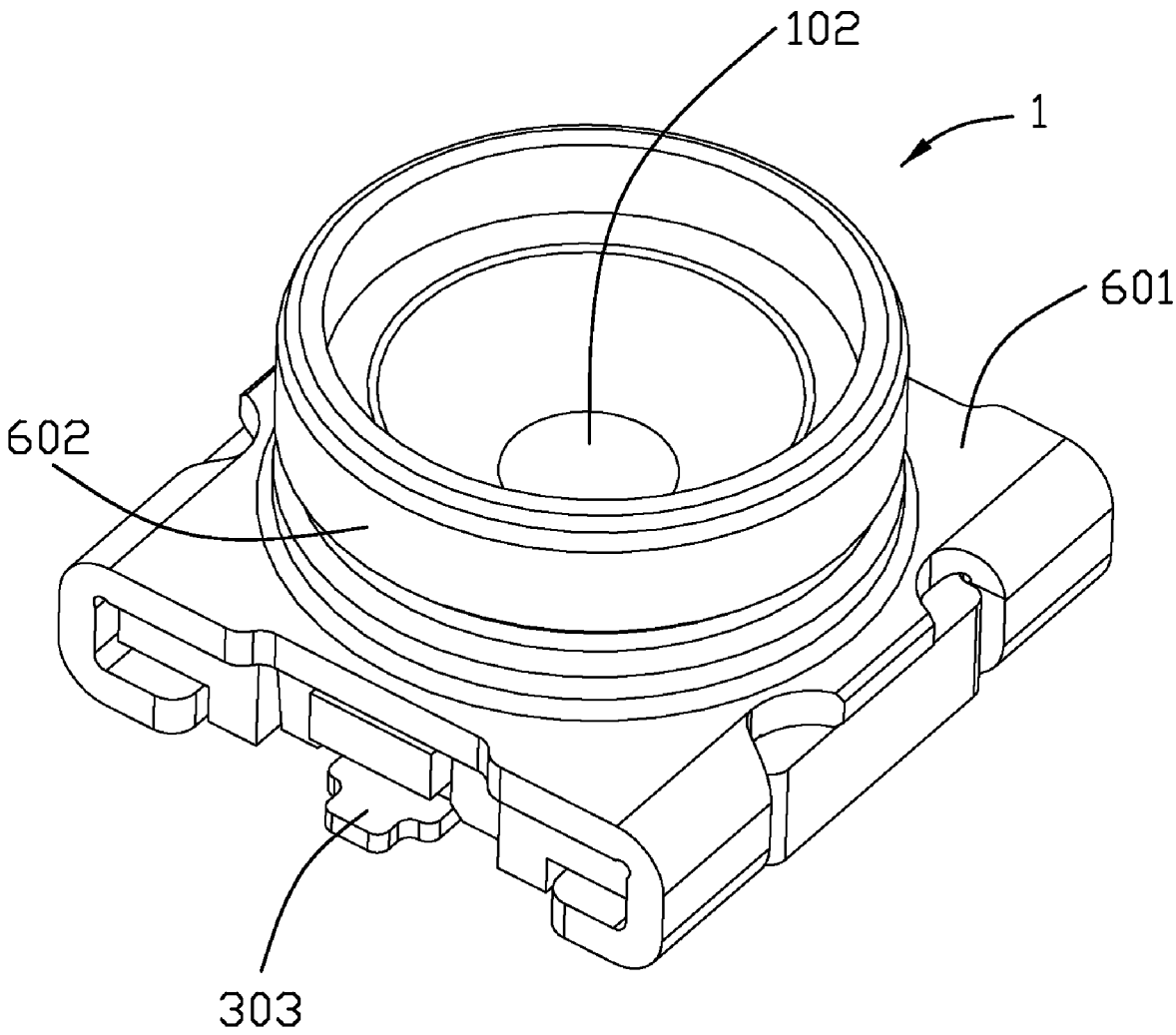
FIG. 1 is an assembled, perspective view of the coaxial connector.

Referring to FIGS. 1-4, a coaxial connector 1 for receipt of a central contact of a mating coaxial connector to be inserted therein, comprises an insulative case including an upper insulative case portion 10 and a lower insulative case portion 20, the lower insulative case portion 10 defining a space section 201 thereof; an upper fixed contact 30, a movable contact 40 and a bottom fixed contact 50 essentially stacked in a vertical direction and received in the space section 201; and a metal shell 60 shielding the insulative case.

Figure 2:
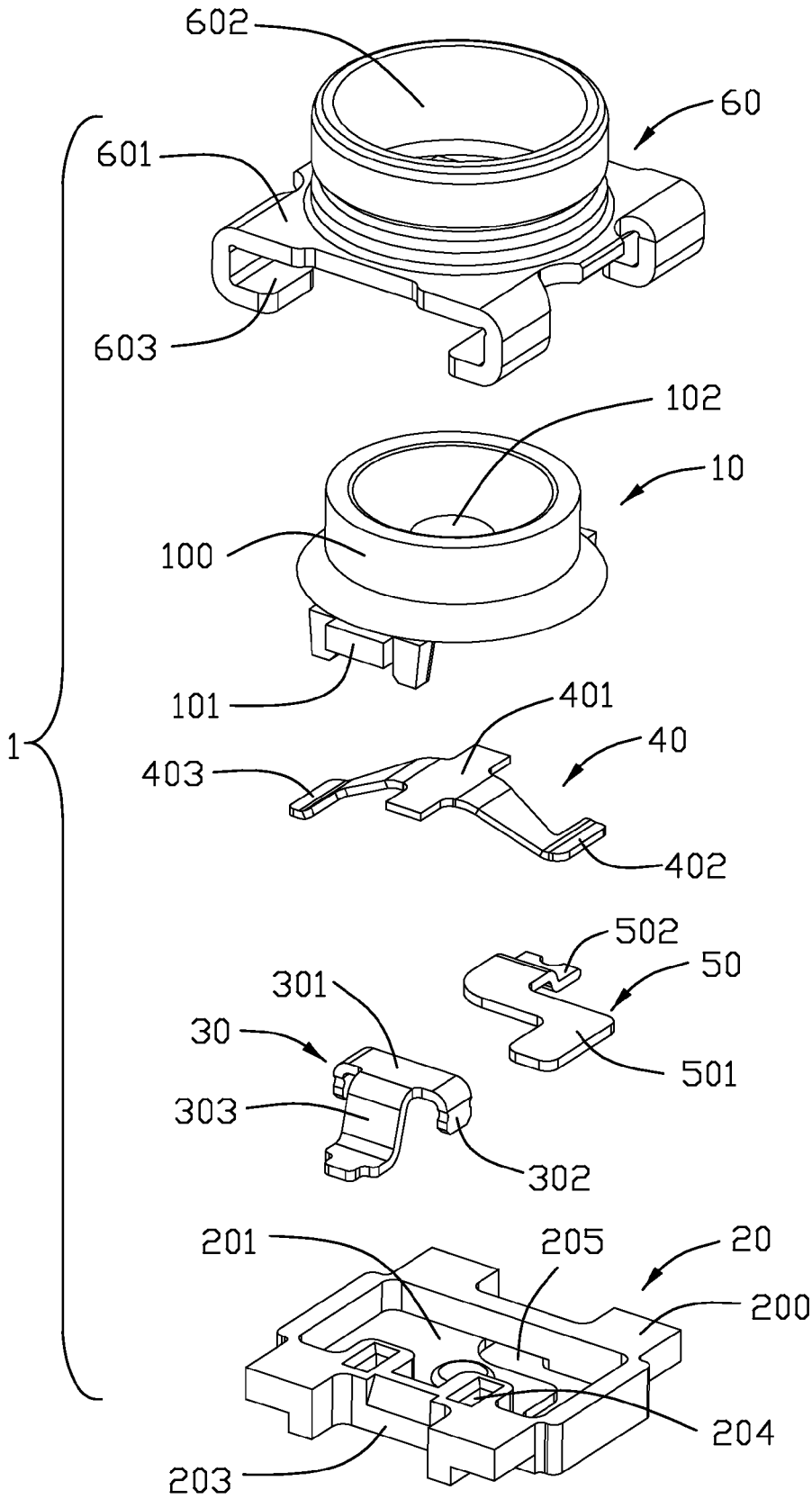
FIG. 2 is an exploded, perspective view of a coaxial connector embodying the concepts of the invention.
Figure 3:
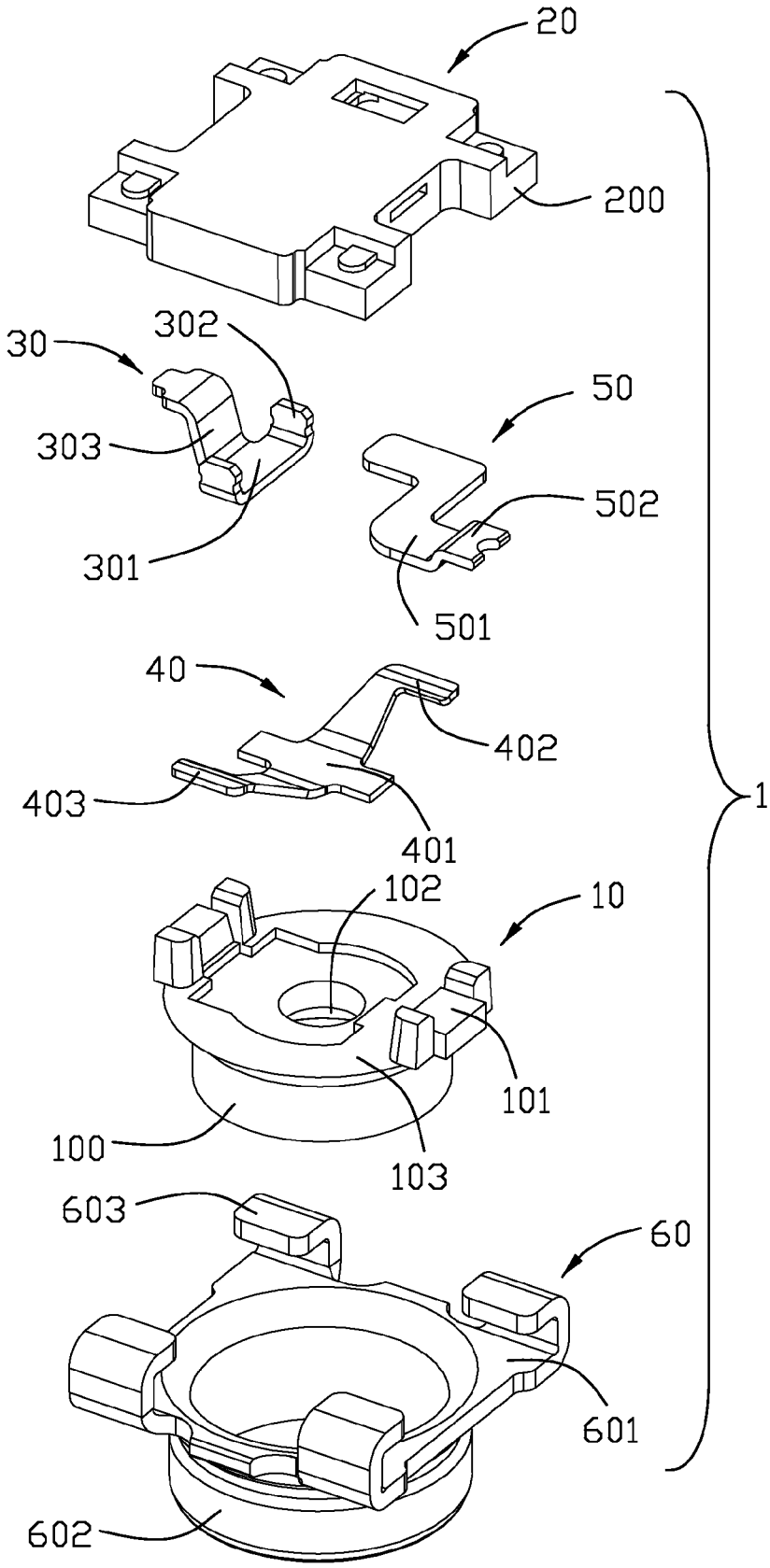
FIG. 3 is another exploded, perspective view of a coaxial connector.
Figure 4:
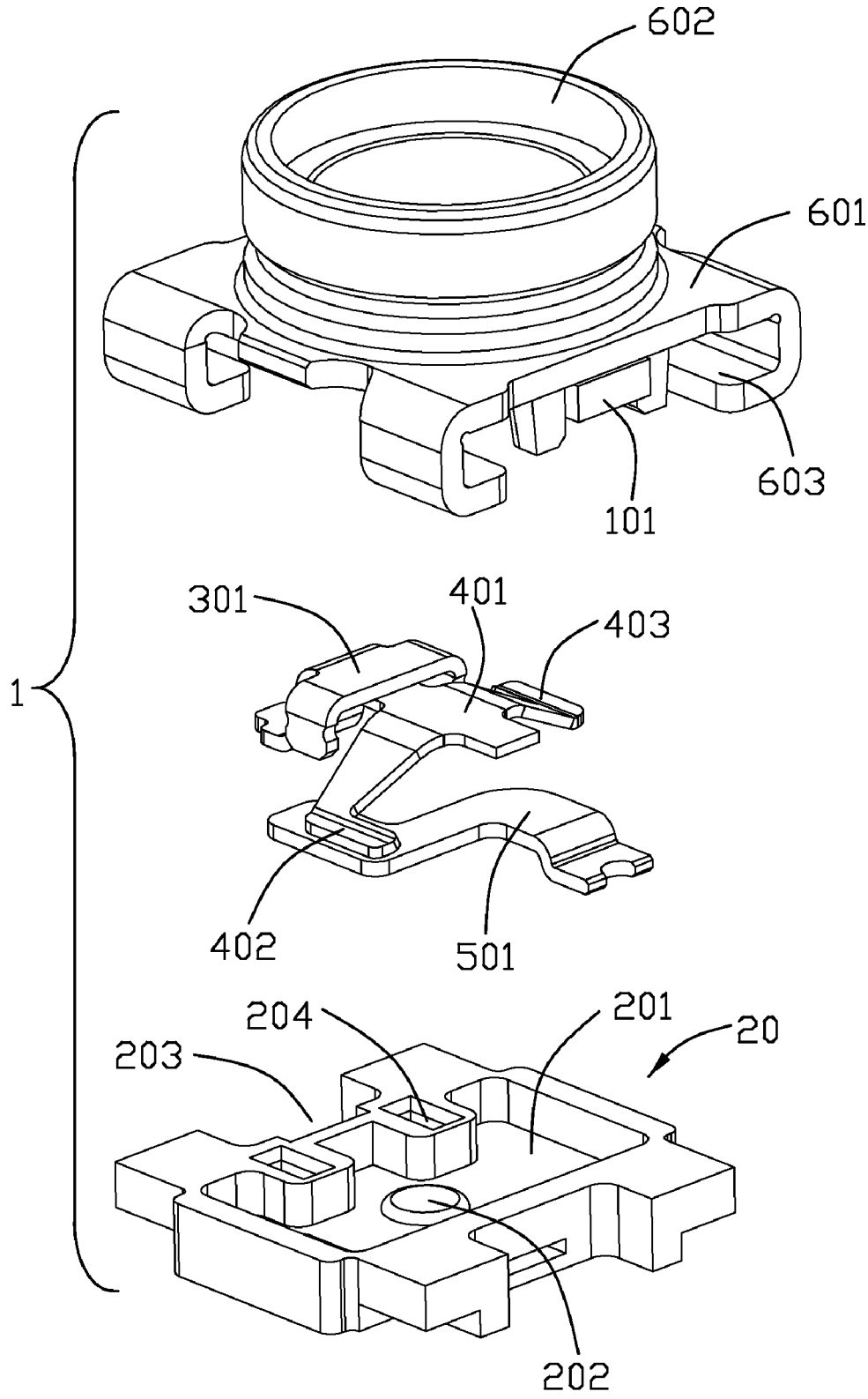
FIG. 4 is a partly-exploded, perspective view of the coaxial connector of FIG. 2, showing contacts assembly including an upper fixed contact, a movable contact and a bottom fixed contact assembled at an initial position where a complementary coaxial connector is detached.

Referring to FIGS. 1-2, the upper insulative case portion 10 includes a mating section 100 with a pair of retention blocks 101 defined on a bottom surface 103 symmetrically. A pin hole 102 for receiving a contact of a mating coaxial connector runs through the upper insulative case portion 10 along a direction which is perpendicular to the bottom surface 103.

The lower insulative case portion 20 includes a base section 200 having a space section 201 for receiving the upper fixed contact 30, the movable contact 40 and the bottom fixed contact 50 stacked in a vertical direction in the space section 100, which reduces a transverse width of the space section 100 and thereby achieves a mini-connector; a tuber 202 is defined on the bottom of the space section 201 to support the movable contact 40 to a level at which a central planar contact section 401 of the movable contact 40 will not come in contact with the bottom fixed contact 50, even when the movable contact 40 moves downwardly by an external force designated as "F" from a complementary coaxial connector to be inserted into the connector 1. Two cutouts 203 are separately defined on two opposite sides of the lower insulative case portion 20, the cutouts 203 cooperate with the retention blocks 101 to hold the upper fixed contact 30 in position. A pair of depressions 204 is defined on a side of the lower insulative case portion 20 for the upper fixed contact 30 to be retained therein. A receiving groove 205 is defined on the bottom of the space section 201 for receipt of the bottom fixed contact 50.

Figure 5:
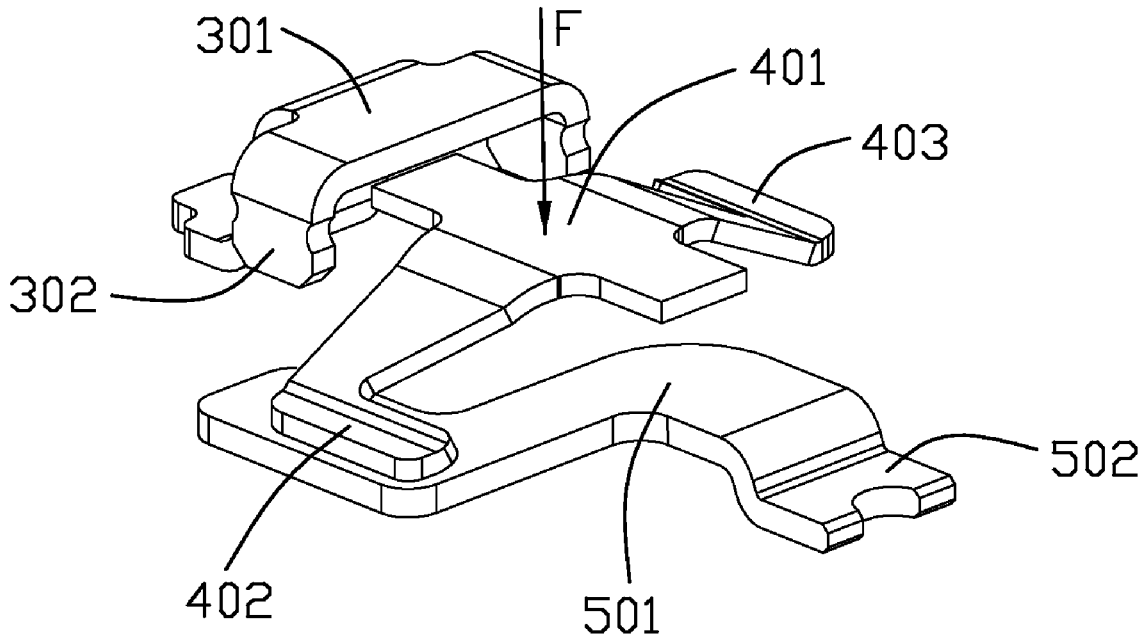
FIG. 5 is a perspective view of the contacts assembly of FIG. 4 where a complementary coaxial connector is attached.

Referring to FIG. 1, FIG. 2 and FIG. 5, the upper fixed contact 30 arranged to be sandwiched by the upper insulative case portion 10 and the lower insulative case portion 20, the upper fixed contact 30 has a planar contact part 301 along a lengthwise direction; a pair of retention legs 302 are defined on the two free ends of the planar contact part 301, and an extending tail 303 extends from another side of the planar contact part 301, the extending tail 303 is received in one of the cutout 203.

The movable contact 40 has a central planar contact section 401, along a transverse direction perpendicular to said lengthwise direction, that is movable and elastic, the central planar contact section 401 arranged to initially come into contact with the contact part of the upper fixed contact 301, the movable contact 40 further including first and second down ends 402, 403 integrally connected to the central planar contact section 401 and retained by the lower insulative case portion 20, said first down end 402 constantly contacting with a planar part 501 of the bottom fixed contact 50. The movable contact 40 designed with a planar contact section 401 provides a contact surface in contact with the contact of a complementary connector, thereby preventing misconnection between the coaxial connector and the mating coaxial connector of the prior art formed with a contact point.

The bottom fixed contact 50 has a planar part 501 on a bottom surface of the space section 201, and a solder tail 502 defined on the planar part 501 retainably extending out of the lower insulative case portion 20.

A metal shell 60 having planar section 601 with a mating promenency 602 protruding therefrom. A plurality of locking barbs 603 is defined on the opposite sides of the planar section 601 symmetrically.

After assembly, the central planar contact section 401 of the movable contact 40 is arranged to be movable from a position at which the movable contact 40 is in contact with the upper fixed contact 30 to a position at which the movable contact 40 is separated from the upper fixed contact 30 while not coming into contact with the bottom fixed contact 50 in accordance with attachment and detachment of a complementary coaxial connector. The central planar contact section 401 ensures that a central contact of a mating coaxial connector can make contact with the movable contact 40 flatly, and prevents the central contact from misconnecting with the movable contact 40.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. A coaxial connector for receipt of a central contact of a mating coaxial connector to be inserted therein, comprising:

an insulative case including an upper insulative case portion and a lower insulative case portion, the lower insulative case portion defining a space section thereof;

an upper fixed contact, a movable contact and a bottom fixed contact retained in the insulative case;

the upper fixed contact exposing to the space section and having a planar contact part along a lengthwise direction thereof;

the movable contact having a central planar contact section, extending along a transverse direction perpendicular to said lengthwise direction, which is movable and elastic, the central planar contact section arranged to initially come into contact with the contact part of the upper fixed contact, the movable contact further including first and second down ends integrally connected to the central planar contact section, said first down end constantly contacting with a planar part of the bottom fixed contact;

the bottom fixed contact having the planar part on a bottom surface of the space section, and a solder tail retainably extending out of the lower insulative case portion; and wherein the contact section of the movable contact is arranged to be movable from a position at which the movable contact is in contact with the upper fixed contact to a position at which the movable contact is separated from the upper fixed contact while not coming into contact with the bottom fixed contact in accordance with attachment and detachment of a complementary coaxial connector;

wherein a pair of depressions are defined in the lower insulative case portion, a pair of retention legs bend downwardly from two ends of the planar contact part of the upper fixed contact and are retained in the depressions correspondingly; and wherein a pair of cutouts are defined on two opposite sides of the lower insulative case portion and a pair of retention blocks are defined on the upper insulative case portion to cooperate with the cutouts interferentially.

2. The coaxial connector as recited in claim 1, wherein the movable contact extends over the lower fixed contact.

3. The coaxial connector as recited in claim 1, wherein a tuber is defined on the bottom surface of the space section supporting the central planar contact section of the movable contact.

4. The coaxial connector as recited in claim 1, wherein the electrical connector further includes a metal shell with a plurality of locking barbs defined thereof.

5. A coaxial connector for mounting to the printed circuit board, comprising:

an insulative housing defining a space section;

a first fixed contact and a second fixed contact respectively retained to the housing, each of said first and second fixed contact having a contact section disposed in the space section and a tail section for connecting to said printed circuit board;

a moveable contact up and down moveably disposed in the space section having a first section constantly engaging the first fixed contact and a second section selectively engaging the second fixed contact; and an upper case mounted upon the housing not only defining a plug passageway therethrough but also preventing upward withdrawal of the moveable contact from the space section; wherein said plug passageway allows a plug to be inserted therethrough and invade the space section to not only mechanically and electrically engage the moveable contact to electrically connect to the first fixed contact but also disengage the movable contact from the second fixed contact; wherein said moveable contact defines two spaced lower supports to elastically support the moveable contact to raise the second section of the moveable contact upwardly;

wherein the second fixed contact is higher than the first fixed contact and the first fixed contact is insert molded within the housing while the second fixed contact is downwardly assembled to the housing;

wherein the upper case is equipped with an outwardly projecting retention block to protect the tail section of the second fixed contact and the two spaced lower supports are respectively located by two sides of the plug passageway in a top view; and wherein the first and second fixed contacts are arranged along a first direction on the housing while the moveable contact is arranged along a second direction perpendicular to said first direction.

6. The coaxial connector as claimed in claim 5, further including a shell enclosing said upper case and the housing.

7. The coaxial connector as claimed in claim 5, wherein the first section of the moveable contact is one of said two lower supports.

8. The coaxial connector comprising:

an insulative housing defining a space section;

an upper fixed contact and a lower fixed contact are disposed on two opposite sides of the housing in a first direction, each of said upper fixed contact and said lower fixed contact including a contact section in the space section and a solder tail exposed outside of the housing;

an up-and-down deflectable contact arranged in a second direction different from said first direction and defining an upper contact section selectively engaging the upper fixed contact and a lower contact section constantly engaging the lower fixed contact; and an upper case mounted upon the housing and defining a plug insertion passageway; and a metallic shell enclosing said upper case and the housing; wherein the upper contact section has a horizontal upper contact face located right below the plug insertion passageway and being moveable in precisely a vertical direction corresponding to insertion of a plug into the plug insertion passageway;

wherein the lower fixed contact is insert molded within the housing while the upper fixed contact is downwardly assembled to the housing; and wherein said housing defines a channel and the moveable contact defines a pair of wings to move along said channel during up-and-down movement of the moveable contact and the wings are located in an opposite direction of the upper contact section of the moveable contact.

9. The coaxial connector as claimed in claim 8, wherein the second direction is perpendicular to the first direction.

* * * * *